US006652729B2

(12) United States Patent
Melody et al.

(10) Patent No.: US 6,652,729 B2
(45) Date of Patent: Nov. 25, 2003

(54) ELECTROLYTE FOR VERY HIGH VOLTAGE ELECTROLYTIC CAPACITORS

(75) Inventors: Brian John Melody, Greer, SC (US); John Tony Kinard, Greer, SC (US); David Alexander Wheeler, Williamston, SC (US)

(73) Assignee: Kemet Electronics Corporation, Simpsonville, SC (US)

( * ) Notice: Subject to any disclaimer, the term of this patent is extended or adjusted under 35 U.S.C. 154(b) by 183 days.

(21) Appl. No.: 10/006,388

(22) Filed: Dec. 10, 2001

(65) Prior Publication Data

US 2003/0111355 A1 Jun. 19, 2003

(51) Int. Cl.[7] ..... C25D 11/06; H01G 9/035

(52) U.S. Cl. ..... 205/234; 205/322; 205/332; 252/62.2; 361/504; 361/505

(58) Field of Search ..... 205/234, 321, 205/322, 324, 325, 332; 252/62.2; 361/504, 505

(56) References Cited

U.S. PATENT DOCUMENTS

| | | | | |
|---|---|---|---|---|
| 1,710,073 A | | 4/1929 | Ruben | |
| 1,815,768 A | | 7/1931 | Georgiev | |
| 1,891,207 A | | 12/1932 | Ruben | |
| 1,986,779 A | | 1/1935 | Lilienfeld | |
| 2,013,564 A | | 9/1935 | Lilienfeld | |
| 3,609,467 A | * | 9/1971 | Curtis | 361/506 |
| 5,160,653 A | * | 11/1992 | Clouse et al. | 252/62.2 |

OTHER PUBLICATIONS

"The Electrolytic Capacitor", Alexander M. Georgiev, Murray Hill Books, Inc., pp. 72.

* cited by examiner

*Primary Examiner*—Roy King
*Assistant Examiner*—William T. Leader
(74) *Attorney, Agent, or Firm*—Banner & Witcoff, Ltd.

(57) ABSTRACT

An electrolyte comprising a polyester condensation product of 2-methyl-1,3-propane diol and boric acid; and further comprising dimethyl amino ethoxy ethanol in an amount to reduce the resistance of the electrolyte. The electrolyte may further comprise ortho-phosphoric acid and at least one substituted pyrrolidone or lactone, such as N-methyl-2-pyrrolidone, N-ethyl-2-pyrrolidone, N-hydroxy ethyl-2-pyrrolidone or 4-butyrolactone. The ortho-phosphoric acid prevents hydration of anodic aluminum oxide in contact with the solution. The pyrrolidone or lactone reduce the resistance of the electrolyte. The electrolyte may also comprise sodium silicate.

28 Claims, No Drawings

ELECTROLYTE FOR VERY HIGH VOLTAGE ELECTROLYTIC CAPACITORS

FIELD OF THE INVENTION

The invention relates to electrolytes for use in electrolytic capacitors.

BACKGROUND OF THE INVENTION

With the development by Ruben (U.S. Pat. No. 1,710,073) in the mid 1920's of largely non-aqueous "working" or "fill" electrolytes containing glycerine and borax (sodium tetraborate decahydrate), the working voltage of aluminum electrolytic capacitors was extended to 200+ volts. Ruben's electrolytes also made possible the modern wound foil and paper separator construction in which the electrolyte is absorbed into the porous separator paper. The use of ammonia/glycerol borate is described on page 72 of the volume, "The Electrolytic Capacitor" Alexander M. Georgiev, Technical Books Division, Murray Hill Books, Inc., New York, 1945.

By the late 1920's, Ruben developed a series of fill electrolytes based upon ethylene glycol, boric acid, and ammonia solutions (U.S. Pat. No. 1,891,207). These so called "glycol-borate" fill electrolytes were found to be capable of satisfactory performance at operating voltages up to about 600 volts. In order to operate above about 450 volts, the ethylene glycol/glycerol and boric acid must be fully esterified and the water removed, and the maximum operating temperature of the capacitor limited to 65 C. or less.

In the 1930's, Lilienfeld patented a series of fill electrolytes (U.S. Pat. Nos. 2,013,564 and 1,986,779) based upon the condensation products of one or more polyethylene glycols with one or more polyfunctional acids to which finely powdered conductive solids, such as Lamp black, copper powder, or aluminum powder, and a small amount of an ionizable alkali metal salt were added. A typical composition described in these patents is a mixture of the polyester formed from triethylene glycol and boric acid with powdered aluminum ("aluminum black") and a very small amount of borax.

The electrolytes of Lilienfeld, described above, have several advantages over earlier electrolytes. The polyesters formed between polyethylene glycols, such as triethylene glycol, and boric acid may be used to anodize to over 1,500 volts, which is far higher than the maximum voltage attainable with the ethylene glycol/boric acid polyester. The electrolytes of Lilienfeld are thick pastes in the normal operating range of high voltage capacitors and capacitors fabricated with them do not require separator papers or may employ reduced thickness and density of separator papers. Capacitors containing the electrolytes of Lilienfeld are much less susceptible to positive tab corrosion from anodic oxidation products than are capacitors containing ethylene glycol-based electrolytes (tab corrosion by the anodic oxidation products of ethylene glycol is discussed in the paper entitled: "The Potential For Positive Tab Corrosion In High Voltage Aluminum Electrolytic Capacitors Caused By Electrolytic Decomposition Products" Brian Melody, Proceedings, 13th Capacitor And Resistor Technology Symposium, Costa Mesa, Calif., pages 199–205, 1993).

Unfortunately, the fill electrolytes of Lilienfeld, described above, have some serious disadvantages from the standpoint of capacitor fabrication on a mass production basis. The consistency of the polyethylene glycol polyesters is such that it is very difficult to wet pre-rolled cartridges with them unless very high impregnation temperatures, i.e., approximately 150° C., are employed. The conductive solids added to reduce the effective resistivity of these electrolytes tend to separate from suspension when the electrolytes are heated to reduce the viscosity to levels which facilitate traditional vacuum impregnation. The combination of these viscosity and suspension properties is such that wet assembly of the capacitor cartridges or stacks is necessary resulting in much lower manufacturing rates and efficiency than is possible with the electrolytes of Ruben, described above. Additionally, the ionizable salts added to the polyethylene glycol polyesters in order to increase oxide film formation efficiency (see U.S. Pat. No. 1,986,779, page 4, Col 2, lines 40–60) tend to reduce the maximum breakdown voltage of the electrolyte.

Perhaps the largest drawback to the use of Lilienfeld's electrolytes is the need to employ anode foil which has been anodized so as to produce a duplex anodic film having a relatively thick layer of non-insulting oxide covering a thinner layer of barrier (insulating) oxide in order to prevent shorting due to the conductive particles present in the electrolyte. The thickness of duplex anodic oxides is such as to preclude the use of modem highly etched aluminum anode foils due to the blockage of the etch tunnels by the non-insulating portion of the duplex anodic oxide; only coarsely etched, relatively low capacitance foils lend themselves to use with Lilienfeld's polyester electrolyte compositions.

The maximum operating voltage of fill electrolytes capable of being use in connection with wound foil and paper cartridges remained at the approximately 600 volt level achieved by Ruben and Lilienfeld until the late 1980's. Clouse, et al., developed a series of fill electrolytes based upon substituted pyrrolidones and poly-pyrrolidones, some variations of which were found to be capable of operation at voltages in excess of 700 volts (U.S. Pat. No. 5,160,653, Example 8 and column 11, lines 22–36).

More recently, Marshall, et. al., developed a series of electrolytes based upon hydrogen bonded (fumed silica-polar solvent) solutions of certain acrylic monomers which are polymerized in situ (i.e., after absorption by the capacitor cartridges). The resulting electrolytes are claimed to be useful to voltages in excess of 700 volts. Unfortunately, the use of reactive monomeric materials may necessitate the use of glove boxes and other moisture control techniques. The polymerization initiators, such as persulfate compounds, may give rise to corrosive by-products, such as sulfates, which may negatively impact device reliability.

BRIEF SUMMARY OF THE INVENTION

The present invention is directed to a new electrolyte for electrolytic capacitors capable of use at very high voltage, that is 800 or more volts. In one embodiment, the electrolyte of the invention is relatively unaffected by exposure to the atmosphere. Another embodiment provides protection against damage due to hydration of the anodic oxide, and provides good service with aluminum foil of much lower purity than is normally used for the fabrication of electrolytic capacitors.

The present invention is directed to an electrolyte comprising a polyester condensation product of 2-methyl-1,3-propane diol and boric acid; and further comprising dimethyl amino ethoxy ethanol. The amine reduces the resistance of the electrolyte.

In another embodiment, the electrolyte further comprises ortho-phosphoric acid and at least one substituted pyrrolidone or lactone. The at least one pyrrolidone or lactone is preferably at least one of N-methyl-2-pyrrolidone, N-ethyl-2-pyrrolidone, N-hydroxy ethyl-2-pyrrolidone or 4-butyrolactone, more preferably, N-hydroxy ethyl-2-pyrrolidone. The ortho-phosphoric acid prevents hydration of anodic aluminum oxide in contact with the solution. The pyrrolidone or lactone reduces the resistance of the electrolyte.

In another embodiment, the electrolyte further comprises sodium silicate. The sodium silicate increases the breakdown voltage of the electrolyte.

Although water is generally not added to the electrolyte, minor amounts of water may be present due to the chemicals used.

The invention is further directed to a method of anodizing or healing any faults or cracks in the dielectric oxide covering the anode surfaces of capacitors impregnated with the electrolyte.

It is to be understood that both the foregoing general description and the following detailed description are exemplary and explanatory only and are not restrictive of the present invention as claimed.

DETAILED DESCRIPTION OF THE INVENTION

It is desirable to produce an electrolyte having a high breakdown voltage, preferably in excess of 800 volts. It is also desirable to produce an electrolyte which may be absorbed into wound or stacked foil and paper capacitor cartridges without the need for "wet" assembly of the capacitor cartridges, glove boxes, or other extreme atmospheric exposure control measures. Preferably, the electrolyte is relatively non-corrosive toward the anode foil and tabs. That is, the electrolyte should not contain chlorides, sulfates, or other corrosive anodic species above low ppm levels. Also preferably, the electrolyte should actively contribute to the prevention of hydration of the anodic oxide, if possible, through the inclusion of anionic species known to contribute to anodic oxide passivation.

Co-pending application Ser. No. 09/693,833, now U.S. Pat. No. 6,346,185, describes the preparation and properties of the polyester condensation product of 2-methyl-1,3-propane diol and boric acid. This condensation product is relatively fluid, even at temperatures substantially below the boiling point of water, and is self-ionized to the extent that it may be employed as a high voltage anodizing electrolyte for valve metal anodes. The material has proven so suitable for high voltage anodizing that even relatively impure aluminum anodes have been anodized to voltages of up to 3,000 volts and above in this medium. Unfortunately, this 2-methyl-1,3-propane dioliboric acid polyester exhibits a very high resistivity, in excess of 100,000 ohm-cm, even at the temperature of boiling water, and is therefore unsuitable for use as a fill electrolyte unless it is modified to reduce the resistivity. Furthermore, anionic additives must be added to the formulation in order to achieve greater hydration resistance to the low level of moisture in the electrolyte.

There are many potential cationic materials which might depress the resistivity such as ammonia, alkali metals, and amines. However, relatively few anionic materials adsorb onto and provide hydration resistance to anodic aluminum oxide. Of those materials known to impart hydration resistance to anodic aluminum oxide, the most effective and least toxic materials are those that give rise to the orthophosphate ion in solution. Unfortunately, very few phosphate salts are soluble in organic solvents.

It was discovered that salts formed by the neutralization of ortho-phosphoric acid with dimethyl amino ethoxy ethanol ($(CH_3)_2NCH_2CH_2OCH_2CH_2OH$), also known as dimethyl ethoxy ethanol amine (DMEEA), are soluble in the polyester condensation product of 2-methyl, 1,3-propane diol and boric acid.

It was further discovered that the resistivity of the electrolyte comprising the polyester condensation product may be reduced substantially by the addition of DMEEA.

Moreover, a small but effective quantity of ortho-phosphoric acid may be added to the electrolyte without precipitation for the purpose of imparting hydration resistance to the anodic aluminum oxide in capacitors containing this electrolyte.

It was then discovered that the resistivity of the polyester condensation product may be reduced further by the addition of one or more substituted pyrrolidones, such as N-methyl-2-pyrrolidone, N-ethyl-2-pyrrolidone, N-hydroxy ethyl-2-pyrrolidone, etc., and/or lactones, such as 4-butyrolactone or valerolactone. N-hydroxy ethyl-2-pyrrolidone is particularly suitable.

However, although an electrolyte prepared with the polycondensation product, DMEEA, phosphoric acid, and pyrrolidones or lactones, provide low resistance, the breakdown voltage is lower than may be desirable. It was further discovered that adding a small (trace) amount of sodium silicate increases the breakdown voltage of the electrolyte.

The polyester condensation product of 2-methyl-1,3-propane diol and boric acid is described in Ser. No. 09/693,833 which is hereby incorporated by reference in it's entirety. The polyester condensation product is formed by combining 2-methyl-1,3-propane diol and boric acid and heating to about 130 to about 160° C. which drives off the water produced by esterification.

The polyester condensation product is the primary ingredient of the electrolyte. The electrolyte contains a sufficient amount of the dimethyl amino ethoxy ethanol to reduce the resistivity of the electrolyte, preferably to below about 10,000 ohm-cm/100° C., preferably about 500 to about 6000 ohm-cm/100° C. more preferably about 5000 to about 6000 ohm-cm/100° C. Generally, the electrolyte contains about 1 wt % to about 10 wt %, preferably about 2 wt % to about 6 wt %, more preferably about 3.5 wt % to about 4.5 wt %, of the dimethyl amino ethoxy ethanol based on the weight of the polyester condensation product.

Preferably, the electrolyte contains an effective amount of ortho-phosphoric acid or ortho-phosphate to prevent hydration of anodic aluminum oxide in contact with the electrolytic solution. Suitable amounts of ortho-phosphoric acid are about 0.1 wt % to about 1.0 wt %, preferably about 0.5 wt % based on the weight of the polyester condensation product.

The electrolyte further contains about 1 wt % to about 10 wt % of at least one substituted pyrrolidone or lactone, preferably about 6 wt % to about based on the weight of the polyester condensation product to further reduce the resistivity of the electrolyte. The at least one pyrrolidone or lactone is preferably at least one of N-methyl-2-pyrrolidone, N-ethyl-2-pyrrolidone, N-hydroxy ethyl-2-pyrrolidone or 4-butyrolactone, more preferably, N-hydroxy ethyl-2-pyrrolidone.

In a further preferred embodiment, the electrolyte further comprises sodium silicate in an amount to increase the breakdown voltage. Only trace amounts of sodium silicate are required, and generally not all of the sodium silicate added to the electrolyte dissolves. Generally, since not all of the sodium silicate dissolves, not more than about 1 wt %, preferably about 0.1 wt %, based on the weight of the polyester condensation product is added to the electrolyte.

The invention, in addition to being a working or fill electrolyte, it is also directed to a method of anodizing or otherwise repairing flaws or cracks in an anodic oxide coating on an anodized valve metal substrate by immersing the substrate (usually contained within the body of an assembled electrolytic capacitor) in the electrolyte solution and applying sufficient anodizing voltage to the solution to effect said oxide repairs.

Although not limited to these temperatures, the present method is preferably operated in the temperature range of about 25 to about 85° C. The highest voltage anodic oxide films require lower anodizing temperatures of 25–50° C., while films formed at higher current densities and to somewhat lower voltages should be produced at temperatures of 50–85° C., where the lower viscosity allows a rapid escape of gas bubbles and the lower resistivity gives rise to a more uniform anodic oxide film thickness in a relatively short period of time.

Although any valve metal may be used, the electrolyte and method of the invention are particularly useful as an electrolyte incorporated within an aluminum electrolytic capacitor and useful as a fill electrolyte to convey current between anode and cathode and repair any flaws or cracks in the anodic oxide.

EXAMPLE 1

This example illustrates the reduction of resistivity obtained through the addition of DMEEA and N-hydroxy ethyl-2-pyrrolidone to poly-2-methyl-1,3-propane diol borate.

In a 250 ml stainless steel beaker, the following was placed:

150 grams, 2-methyl-1,3-propane diol

100grams, boric acid

These materials were heated to 125–130° C. in order to form the polyester and drive-off (evaporate) the approximately 62 grams of water produced by the esterification reaction. The resistivity (1 kHz) of the reaction product (polyester) was 250,000 ohm-cm/110° C. and 350,000 ohm-cm/100° C.

To the approximately 188 grams of polyester reaction product approximately 7.5 grams of dimethyl amino ethoxy ethanol amine was added with stirring. The 1 kHz resistivity of the solution was approximately 5,200 ohm-cm/100° C. The pH was approximately 4 by using Hydrion pH paper. The resistivity was reduced by a factor of over 65-fold.

Approximately 12.5 grams of N-hydroxy ethyl-2-pyrrolidone was added to the solution with stirring. The 1 kHz resistivity was now 5,000 ohm-cm/100° C. This is a reduction in resistivity of approximately 4% even though the solution had been diluted by a factor of approximately 6%. To the solution was added approximately 1 gram of 85% ortho-phosphoric acid. The 1 kHz resistivity was 4,700 ohm-cm/110° C.

An electrolyte may be prepared based upon the polyester reaction product of 2-methyl-1,3-propane diol and boric acid having a resistivity significantly below that of the pure polyester and containing an amount of ortho-phosphate (approximately 0.5%) sufficient to prevent hydration of anodic aluminum oxide in contact with the electrolyte.

However, the inclusion of phosphate in the electrolyte solution reduced the breakdown voltage of the electrolyte. Breakdown voltage testing of the electrolyte using pre-anodized aluminum coupons (anodized to voltages between 1,000 and 2,000 volts in poly-2-methyl-1,3-propane diol borate) revealed a significant reduction in breakdown voltage at 25° C.

It was discovered that the presence of very small amounts of silicate in the phosphate-containing electrolyte greatly enhanced the breakdown voltage performance of the electrolyte solution. The exact mechanism of the breakdown voltage enhancement due to the presence of the silicate is not known, but it is believed to be associated with the glass-forming properties of silicates.

EXAMPLE 2

This example details the advantages obtained through the addition of a small amount (0.1%) of sodium silicate (sodium meta-silicate) to the electrolyte of Example 1, in spite of the fact that most of the silicate remains undissolved. The breakdown voltage was tested with the same low purity pre-anodized coupons mentioned above.

Upon standing in contact with the atmosphere at room temperature, the electrolyte solution solidified, forming a fairly rigid but waxy (non-crystalline) solid which, while somewhat hygroscopic, is not "wet" in the sense that it does not flow if a container of it is overturned.

The breakdown voltages obtained under constant current conditions at 30° C. for pre-formed coupons (1,500–2,000 volts) are provided below for the 2-methyl-1,3-propane diol borate electrolyte after the additions of the various components listed above (same concentrations).

TABLE 1

| Material | Breakdown Voltage |
|---|---|
| Poly-2-methyl-1,3-propane diol borate | 500–600 volts |
| plus dimethyl amino ethoxy ethanol | |
| plus ortho-phosphoric acid | 300–400 volts |
| and N-hydroxy ethyl-2-pyrrolidone | |
| plus sodium silicate | 800–850 volts |

With appropriately anodized foil, the electrolyte of the invention will withstand the application of 800 volts or more without sparking.

EXAMPLE 3

This example demonstrates the ability of the electrolyte of the invention to support the "aging down" or progressive diminution of the leakage current of an electrolytic capacitor containing this electrolyte even under conditions which are much more extreme than those encountered with capacitors manufactured with the usual high-purity materials and voltage de-rating (i.e., the capacitors are seldom exposed to voltages in excess of ¾ of the anodizing voltage unless severe temperature restrictions are applied, such as operation at 40° C. or below).

A coupon of low purity (approximately 98%) aluminum foil was anodized to 500 volts at 25° C. in the polyester addition product of 2-methyl-1,3-propane diol and boric acid heated to 135° C. to drive off the water produced by the esterification reaction.

A quantity of the diol-borate polyester was placed in a stainless steel beaker which served as the cell cathode, and a magnetic stirring was used to stir the solution. The aluminum coupon, pre-anodized to 500 volts at 25° C., was immersed in this solution.

An amount of dimethyl amino ethoxy ethanol equal to 6% of the weight of the ester was added and the solution was then heated to approximately 90° C. A current of 1.3 milliamperes/cm$^2$ was applied and the maximum voltage the electrolyte supported was approximately 245 volts.

An amount of N-hydroxy ethyl-2-pyrrolidone equal to 10% of the weight of the diol ester was added. The maximum voltage the electrolyte supported at 1.3 milliamperes/cm$^2$, at 80° C., was approximately 221 volts.

An amount of phosphoric acid (85%) equal to 1% of the weight of the diol borate ester was added. The maximum voltage the electrolyte supported was found at 1.3 milliamperes/cm$^2$, at 80° C., was approximately 250 volts.

An amount of sodium meta-silicate equal to 1% of the weight of the diol borate ester was added (most did not dissolve). The maximum voltage the electrolyte supported was not determined, but the voltage reached 500 volts at 80° C. and "aged down" to less than 0.25 milliamperes/cm$^2$ within 25 minutes.

The coupon is, then, "aging down" in the electrolyte of the invention at a voltage stress level 12% in excess of the anodizing voltage when the temperature is considered. This rather severe test of the electrolyte is at elevated temperature (80° C.) and with a very impure foil sample (98%, instead of the 99.98–99.99+% foil usually used for high voltage capacitor applications).

The electrolyte is very resistant to electrical stress and foil purity factors. This example also illustrates the critical part played by the silicate addition in enhancing the electrolyte performance more than doubling the withstanding voltage with the same oxide thickness in the present example.

EXAMPLE 4

In order to demonstrate the ability of the electrolyte of the invention to repair flaws in the anodic oxide on anodized aluminum foil, to resist exposure to atmospheric moisture and contaminants, and to function with foil of a purity level below that normally employed for the fabrication of electrolytic capacitors, a sample of the electrolyte of Example 1 was used to fill a stainless steel beaker. A coupon of low purity aluminum foil (98%) which had been anodized to 600 volts at 85° C. in the 2-methyl-1,3-propane diol borate polyester was immersed in the beaker containing the electrolyte solution of Example 1 and the electrolyte solution was cooled to room temperature and allowed to harden to a wax-like solid while exposed to the room atmosphere. The aluminum coupon was then biased positive (the beaker being negative) to a potential of 500 volts at a current of 10 milliamperes/cm$^2$. The coupon rapidly "aged down" to a current of only 10 microamperes/cm$^2$. After one hour with 500 volts applied, the coupon exhibited a leakage current of approximately 5–10 microamperes/cm$^2$. The beaker containing the electrolyte was exposed to the atmosphere for a period of over 18 months. Every six months, 500 volts was applied to the coupon and the "age down" behavior of the current observed initially was repeated. The exposure to the atmosphere was found to have little impact upon the leakage current of the device. There was no evidence of damage to the anodic oxide from hydration or to the electrolyte from the exposure to the atmosphere.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

We claim:

1. An electrolyte comprising a polyester condensation product of 2-methyl-1,3-propane diol and boric acid; and further comprising dimethyl amino ethoxy ethanol.

2. The electrolyte composition of claim 1 wherein the 2-methyl-1,3-propane diol and boric acid are reacted in about equi-molar amounts.

3. The electrolyte of claim 1 wherein the dimethyl amino ethoxy ethanol is present in an amount effective to reduce the resistance of the electrolyte to below about 10,000 ohm-cm/100° C.

4. The electrolyte of claim 1 wherein the electrolyte contains about 1 wt % to about 10 wt %, of the dimethyl amino ethoxy ethanol based on the weight of the polyester condensation product.

5. The electrolyte of claim 4 wherein the electrolyte contains about 2 wt % to about 6 wt % of the dimethyl amino ethoxy ethanol based on the weight of the polyester condensation product.

6. The electrolyte of claim 1 further comprising ortho-phosphoric acid in an amount effective to prevent hydration of anodic aluminum oxide.

7. The electrolyte of claim 6 wherein the amount of ortho-phosphoric acid is 0.1 wt % to about 1.0 wt % based on the weight of the polyester condensation product.

8. The electrolyte of claim 6 further comprising at least one substituted pyrrolidone or lactone.

9. The electrolyte of claim 8 wherein the at least one pyrrolidone or lactone is at least one of N-methyl-2-pyrrolidone, N-ethyl-2-pyrrolidone, N-hydroxy ethyl-2-pyrrolidone, valerolactone, or 4-butyrolactone.

10. The electrolyte of claim 9 wherein the at least one pyrrolidone or lactone is N-hydroxy ethyl-2-pyrrolidone.

11. The electrolyte of claim 8 wherein the amount of pyrrolidone or lactone is about 1 wt % to about 10 wt % based on the weight of the polyester condensation product.

12. The electrolyte of claim 8 further comprising sodium silicate.

13. An electrolyte comprising a polyester condensation product of 2-methyl-1,3-propane diol and boric acid; dimethyl amino ethoxy ethanol; ortho-phosphoric acid; at least one pyrrolidone or lactone; and sodium silicate.

14. The electrolyte of claim 13 wherein the at least one pyrrolidone or lactone is at least one of N-methyl-2-pyrrolidone, N-ethyl-2-pyrrolidone, N-hydroxy ethyl-2-pyrrolidone, valerolactone or 4-butyrolactone.

15. The electrolyte of claim 14 wherein the at least one pyrrolidone or lactone is N-hydroxy ethyl-2-pyrrolidone.

16. An electrolyte comprising a polyester condensation product of 2-methyl-1,3-propane diol and boric acid; and about 2 wt % to about 6 wt % of dimethyl amino ethoxy ethanol; about 0.1 wt % to about 1.0 wt % ortho-phosphoric acid; about 6 wt % N-hydroxy ethyl-2-pyrrolidone; and sodium silicate all percentages being based on the weight of the polyester condensation product.

17. A method of anodizing a valve metal substrate or repairing flaws in an anodic oxide coating a valve metal substrate comprising immersing the substrate in an electrolyte and applying sufficient anodizing voltage to the solution; wherein the electrolyte solution comprises a polyester condensation product of 2-methyl-1,3-propane diol and boric acid; and dimethyl amino ethoxy ethanol.

18. The method of claim 17 wherein the valve metal is aluminum.

19. The method of claim 17 wherein the 2-methyl-1,3-propane diol and boric acid are reacted in about equi-molar amounts.

20. The method of claim 17 wherein the substrate is immersed in the electrolyte at a temperature of about 25° C. to about 85° C.

21. The method of claim 20 wherein the substrate is immersed in the electrolyte at a temperature of about 25° C. to about 50° C.

22. The method of claim 20 wherein the substrate is immersed in the electrolyte at a temperature of about 50° C. to about 85° C.

23. The method of claim 17 wherein the electrolyte further comprises ortho-phosphoric acid in an amount effective to prevent hydration of anodic aluminum oxide.

24. The method of claim 17 wherein the electrolyte further comprises at least one substituted pyrrolidone or lactone.

25. The method of claim 24 wherein the at least one pyrrolidone or lactone is at least one of N-methyl-2-pyrrolidone, N-ethyl-2-pyrrolidone, N-hydroxy ethyl-2-pyrrolidone, valerolactone or 4-butyrolactone.

26. The method of claim 25 wherein the at least one pyrrolidone or lactone is N-hydroxy ethyl-2-pyrrolidone.

27. The method of claim 17 wherein the electrolyte further comprises sodium silicate.

28. A method of anodizing a valve metal substrate or repairing flaws in an anodic oxide coating a valve metal substrate comprising immersing the substrate in an electrolyte and applying sufficient anodizing voltage to the solution; wherein the electrolyte solution comprises a polyester condensation product of 2-methyl-1,3-propane diol and boric acid; dimethyl amino ethoxy ethanol; ortho-phosphoric acid; at least one pyrrolidone or lactone; and sodium silicate.

* * * * *